United States Patent [19]

Beloy

[11] 4,023,779

[45] May 17, 1977

[54] FIBROUS CONCRETE MIXING SYSTEM

[75] Inventor: Francis J. Beloy, Peoria, Ill.

[73] Assignee: Caterpillar Tractor Co., Peoria, Ill.

[22] Filed: Aug. 9, 1976

[21] Appl. No.: 712,556

[52] U.S. Cl. ..... 259/165; 259/14

[51] Int. Cl.[2] ..... B28C 5/20; B28C 5/40

[58] Field of Search ..... 259/153, 145, 146, 165, 259/164, 3, 14, 2, 36, 169, 170, 175, 176, 177 R, 1; 214/17 D, 17 C; 106/100

[56] References Cited

UNITED STATES PATENTS

| | | | |
|---|---|---|---|
| 1,660,280 | 2/1928 | Thomson | 259/146 |
| 2,230,880 | 2/1941 | Brown | 259/169 |
| 2,533,852 | 12/1950 | Tietig | 259/146 |
| 3,667,736 | 6/1972 | Carroll | 259/169 |

*Primary Examiner*—Robert W. Jenkins

*Attorney, Agent, or Firm*—Wegner, Stellman, McCord, Wiles & Wood

[57] ABSTRACT

A fibrous concrete batch forming system including a bin for receiving fibers having an outlet partially closed by a grate, a toothed member cyclically movable such that the teeth thereon enter the bin to extract substantially individual fibers therefrom through the grate, a fiber separator having an inlet and an outlet with a plurality of rotary shafts with intermeshed teeth between the inlet and the outlet for further separating fibers, a first conveyor for receiving the fibers from the bin and conveying the same to the separator inlet, a second conveyor for receiving the fibers from the separator outlet, a rotary mixing drum having an inlet and mounted for rotation about an axis at an acute angle to its longitudinal axis, a mounting for the second conveyor so that the same may move between a position wherein it enters the drum inlet and a position out of the inlet, dispensers for depositing predetermined concrete ingredients on the second conveyor and a further dispenser for depositing other concrete ingredients within the drum including a funnel pivotally mounted for movement between a position wherein a dispensing end of the funnel is within the drum inlet and a position wherein the dispensing end is remote from the drum inlet and out of the path of reciprocation of the second conveyor.

5 Claims, 1 Drawing Figure

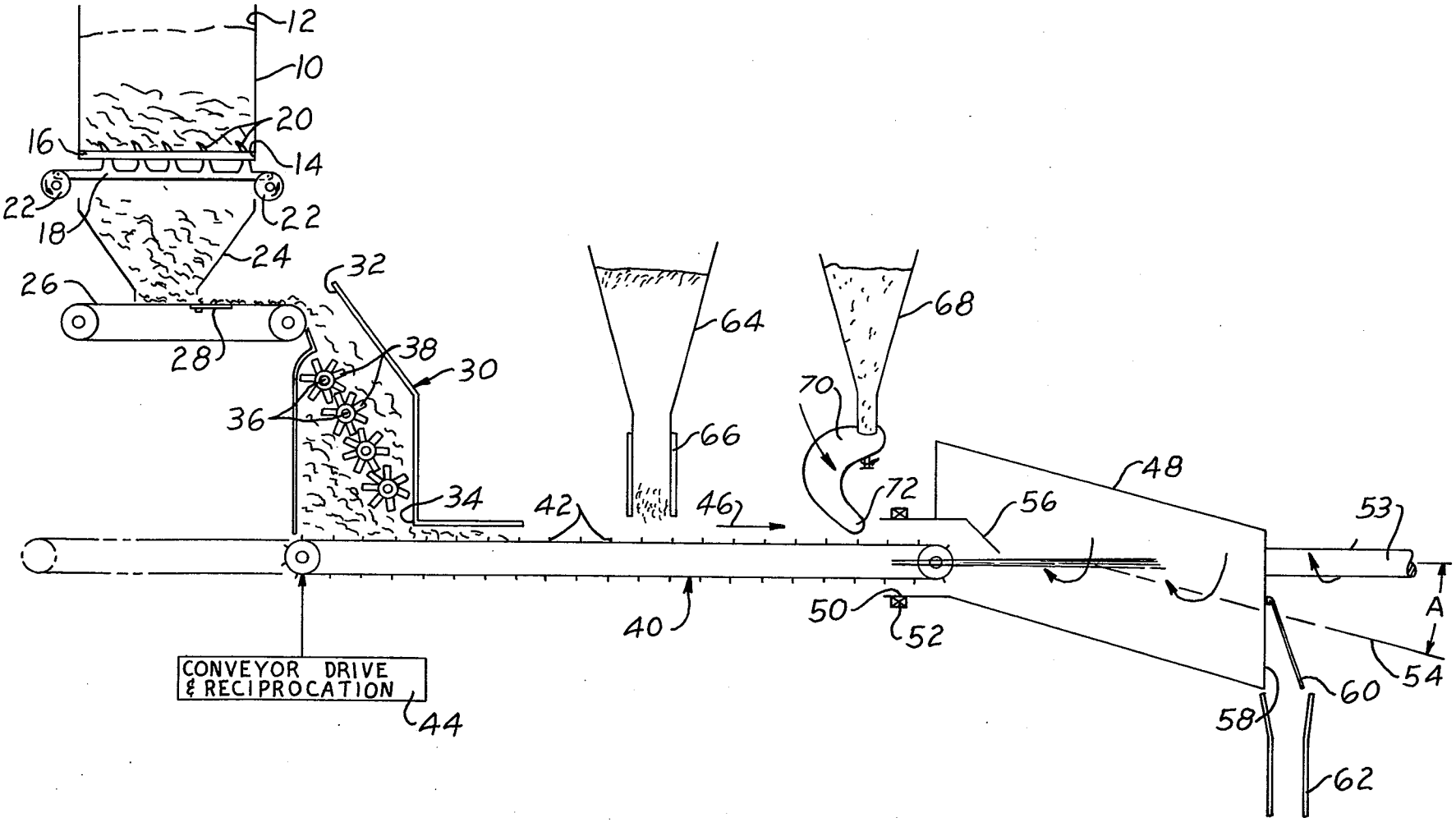
CONVEYOR DRIVE & RECIPROCATION

FIBROUS CONCRETE MIXING SYSTEM

BACKGROUND OF THE INVENTION

This invention relates to concrete batch forming systems, and, more specifically, to batch forming systems for fibrous concrete.

The desirability of employing fibrous reinforcing material in concrete has been known for a number of years. In many instances, the use of fiber reinforcing material eliminates the need for reinforcing rods in that fiber reinforced concrete can have the strength of rod reinforced concrete and can be formed at a lesser cost. Where the concrete is used in roadways or the like, the presence of the fibers at the exposed surface of the roadway also provides improved wear resistance.

One perplexing difficulty that has stymied extensive use of fiber reinforced concrete is the tendency of the fibers to adhere to each other and form balls which are not fully wetted by the concrete mix itself resulting in a poor bond and decreased strength as a result. Where the balls of fiber are of significant size, a partial void will result in the concrete with a resultant flaw or weak spot.

SUMMARY OF THE INVENTION

It is the principal object of the invention to provide a new and improved fibrous concrete forming system. More specifically, it is an object of the invention to provide such a system wherein fibrous reinforcing material is added to other solid concrete ingredients as substantially individual fibers and wherein the addition of balls of fiber to the ingredients is precluded.

An exemplary embodiment of the invention achieves the foregoing objects in a structure including a bin for receiving fibers and having an outlet partially closed by a grate. A toothed member is located in proximity to the grate and means are provided for cyclically causing the tooth on the member to enter the bin through the grate to extract substantially individual fibers therefrom. A fiber separator having an inlet and an outlet and a plurality of rotary shafts with intermeshed teeth between the inlet and the outlet is provided for further separating the fibers. A first conveyor receives fibers from the bin and conveys the same to the separator inlet. A second elongated conveyor is provided for receiving the separated fibers from the separator outlet and a rotary mixing drum having an inlet and being mounted for rotation about an axis at an acute angle to its longitudinal axis is disposed such that the second conveyor enters the drum. Means are provided for depositing predetermined concrete ingredients on the second conveyor.

In a preferred embodiment of the invention, the second conveyor is reciprocal between a position wherein it partially enters the drum inlet and a position out of the inlet. A dispenser is provided for depositing other predetermined concrete ingredients within the drum and includes a funnel mounted for movement between a position wherein a dispensing end of the funnel is within the drum inlet and a position wherein the dispensing end is remote from the drum inlet and out of the path of reciprocation of the conveyor.

In a highly preferred embodiment, the drum includes an outlet remote from the inlet and there is provided a selectively operable closure for the drum outlet.

Other objects and advantages will become apparent from the following specifications taken in connection with the accompanying drawings.

DESCRIPTION OF THE DRAWINGS

The FIGURE is a somewhat schematic view of a fibrous concrete mixing system made according to the invention.

DESCRIPTION OF THE PREFERRED EMBODIMENT

An exemplary embodiment of a fibrous concrete mixing system made according to the invention is illustrated in the FIGURE and is seen to include a bin 10 for receiving fibers to be introduced into the concrete through an inlet 12. The bin 10 has a lower outlet 14 which is partially closed by a grate 16 formed of a series of parallel bars or the like.

Below the grate 16, there is disposed a plurality of bars 18 each having a plurality of upstanding teeth 20 disposed to be enterable into the bin 10 through the grate 16. Opposite ends of the bars 18 are mounted pivotally and eccentrically to discs 22 which are rotatable in synchronism with each other by means not shown. As a consequence of this construction, the bars 18, and thus the teeth 20, will oscillate both vertically and horizontally. When the bars 18 are in their uppermost positions as illustrated in the FIGURE, the teeth 20 will move through the fibers within the bin 10 to extract substantially individual fibers from the bin. When the discs 22 have rotated approximately 180° from the position shown, the teeth 20 will be withdrawn from the bin 10 to move to the right, as viewed in the FIGURE, for subsequent reinsertion in the bin and further extraction. Preferably, when the type of movement just described is employed, the teeth 20 are inclined in their direction of movement while in the bin 10 to provide a more positive grab of the fibers therein.

A chute 24 is disposed below the bars 18 to receive the substantially individual fibers emanating from the bin 10 and direct them to an underlying conveyor 26. Preferably, the conveyor 26 is of the belt type so as to present a flat conveying surface to the fibers to prevent them from agglomerating and rejoining into troublesome balls.

Associated with the conveyor 26 is a weigh cell 28 which, by conventional means, is utilized to determine the quantity of fiber on the conveyor 26 so as to control its speed and/or the operation of the bars 18 to apportion the fibers in a proper amount. The conveyor 26 conveys the substantially individual fibers to a separator, generally designated 30, having an upper inlet 32 through which the fibers are introduced by the conveyor 26. The separator 30 has a lower outlet 34 and interposed between the inlet 32 and the outlet 34 are a plurality of shafts 36 which are rotated by any suitable motor device (not shown) and which have radially outwardly extending teeth 38, the teeth 38 on one shaft intermeshing with the teeth on the adjacent shaft or shafts. The teeth provide a further separation of the fibers to ensure that only individual fibers will emanate from the outlet 34.

Below the outlet 34 is a horizontally disposed conveyor, generally designated 40. The conveyor 40, like the conveyor 26, is preferably of the belt type and, if desired, may be provided with cleats 42 to ensure positive advancement of material deposited thereon.

By any suitable frame (not shown) the conveyor 40 is mounted for reciprocation between the solid and dotted line positions illustrated in the FIGURE. A mechanism shown schematically at 44 is provided for the purpose of driving the conveyor such that its upper run travels in the direction of an arrow 46 and for selectively reciprocating the conveyor 40 as mentioned.

At the end of the conveyor 40 opposite from the separator 30, there is provided a mixing drum 48 having an inlet 50 which generally will be tubular in nature and journalled in a bearing 52. The drum 48 may be cylindrical and is rotated by a driven shaft 53 about an axis coaxial with the bearing 52 which is at an acute angle A with the longitudinal axis 54 of the drum. As a consequence of this construction, ingredients within the drum will roll in the usual fashion and will also be shifted from end to end to provide excellent mixing without the need for agitator vanes or the like within the drum.

A baffle 56 is located within the drum in connection with the tube 50 to preclude ingredients from splashing out of the inlet defined thereby.

The end of the drum 48 opposite from the inlet defined by the tube 50 includes an outlet 58. A suitable closure 60 is hinged or the like to the drum for selectively opening or closing the outlet 58 and there is located a chute 62 for conveying mixed concrete to some desired point of use.

Intermediate the drum 48 and the separator 30 and above the conveyor 40 is a hopper 64 for depositing cement or the like on the conveyor. Apportioning means 66 of conventional construction are associated with the discharge end of the hopper 64 so as to apportion cement onto the conveyor 40 in the desired proportions.

A hopper 68 is located in proximity to the inlet 50 to the drum 48 and is adapted to receive aggregate and/or sand. The hopper 68 has at its discharge end, a funnel 70 which is pivoted so as to be movable between the position illustrated in FIG. 2 and a position within the tubular inlet 50 of the mixer so as to deliver the aggregate and/or sand directly to the interior of the drum 48.

As can be seen in the FIGURE, the conveyor 40 is reciprocable between a position wherein one end is within the inlet and another position wherein that end is remote from the inlet 50. At the same time, the funnel 70 has its discharge end 72 mounted for movement between a position within the inlet 50 of the drum 48 and the solid line position illustrated wherein it is remote from the inlet and out of the path of reciprocation of the conveyor 40.

Water or the like may be introduced into the mixer by means of a water lance (not shown) when the funnel 70 is in the solid line position and the conveyor 40 is in the dotted line position. Suitable controls can be provided in the form of electrical interlocks to prevent simultaneous insertion of two or more of the funnels 70, the conveyor 40 and the water lance and other apportioning devices, well known in the art, may be utilized to ensure that all ingredients are introduced into the mixer 48 in the correct proportions.

From the foregoing, it will be appreciated that the resulting fibrous concrete will be substantially free from undesirable balls in that the fibers are completely separated prior to their being deposited on the conveyor 40. Since fibers on the conveyor 40 are introduced in relatively small quanities because of progressive movement of the conveyor 40 along with other ingredients, it will be appreciated that there is very little opportunity for the fibers to agglomerate after being separated. As a consequence, fibrous concrete made with an apparatus according to the invention exhibits substantially greater strength characteristics than fibrous concrete made according to the prior art techniques.

What is claimed is:

1. A fibrous concrete batch forming system, comprising:

a bin for receiving fibers and having an outlet partially closed by a grate;

a toothed member in proximity to said grate;

means for cylically causing the tooth on said member to enter said bin to extract substantially individual fibers therefrom through said grate;

A fiber separator having an inlet and an outlet and having a plurality of rotary shafts with intermeshed teeth between said inlet and said outlet for further separating said fibers;

a first conveyor for receiving said substantially individual fibers and conveying the same to said separator inlet;

a second, elongated conveyor for receiving said further separated fibers from said separator;

a rotary mixing drum having an inlet, said drum being mounted for rotation about an axis at an acute angle to its longitudinal axis;

means for reciprocating said second conveyor between a position wherein said second conveyor enters said drum inlet and a position out of said inlet;

means for depositing predetermined concrete ingredients on said second conveyor; and means for depositing other predetermined concrete ingredients within said drum including a funnel pivotally mounted for movement between a position wherein a dispensing end of said funnel is within said drum inlet and a position wherein said dispensing end is remote from said drum inlet and out of the path of reciprocation of said second conveyor.

2. The fibrous concrete batch forming system of claim 1 further including an outlet in said drum remote from said drum inlet, and a selectively operable closure for said drum outlet.

3. A fibrous concrete batch forming system, comprising:

a fiber separator having an inlet and an outlet and including means between said inlet and said outlet for separating fiber balls into substantially individual fibers;

a conveyor for receiving said separated fibers from said separator;

a rotary mixing drum having an inlet;

means for reciprocating said conveyor between a position wherein said conveyor enters said drum inlet and a position out of said inlet;

means for depositing predetermined concrete ingredients on said conveyor; and means for depositing other predetermined concrete ingredients within said drum including a funnel mounted for movement between a position wherein a dispensing end of said funnel is within said drum inlet and a position wherein said dispensing end is remote from said drum inlet and out of the path of reciprocation of said conveyor.

4. A fibrous concrete batch forming system, comprising:

a bin for receiving fibers and having an outlet partially closed by a grate;

a toothed member in proximity to said grate;

means for cyclically causing the tooth on said member to enter said bin to extract substantially individual fibers therefrom through said grate;

a conveyor for receiving said substantially individually fibers from said bin;

a rotary mixing drum having an inlet;

means for reciprocating said conveyor between a position wherein said conveyor enters said drum inlet and a position out of said inlet;

means for depositing predetermined concrete ingredients on said conveyor; and means for depositing other predetermined concrete ingredients within said drum including a funnel mounted for movement between a position wherein a dispensing end of said funnel is within said drum inlet and a position wherein said dispensing end is remote from said drum inlet and out of the path of reciprocation of said conveyor.

5. a fibrous concrete batch forming system, comprising:

a bin for receiving fibers and having an outlet partially closed by a grate;

a toothed member in proximity to said grate;

means for cyclically causing the tooth on said member to enter said bin to extract substantially individual fibers therefrom through said grate;

a fiber separator having an inlet and an outlet and having a plurality of rotary shafts with intermeshed teeth between said inlet and said outlet for further separating said fibers;

a first conveyor for receiving said substantially individual fibers and conveying the same to said separator inlet;

a second, elongated conveyor for receiving said further separating fibers from said separator;

a rotary mixing drum having an inlet, said drum being mounted for rotation about an axis at an acute angle to its longitudinal axis;

said second conveyor entering said drum inlet; and means for depositing predetermined concrete ingredients on said second conveyor.

* * * * *

UNITED STATES PATENT AND TRADEMARK OFFICE

CERTIFICATE OF CORRECTION

PATENT NO. : 4,023,779

DATED : May 17, 1977

INVENTOR(S) : Francis J. Beloy

It is certified that error appears in the above-identified patent and that said Letters Patent are hereby corrected as shown below:

Column 5, lines 9-10, "individually" should read --individual--.

Column 6, line 17, "separating" should read --separated--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*